US005842837A

United States Patent [19]

Nakayoshi et al.

[11] Patent Number: 5,842,837

[45] Date of Patent: Dec. 1, 1998

[54] TANDEM PUMP APPARATUS

[75] Inventors: Hideki Nakayoshi; Naoki Oogushi, both of Aichi-pref., Japan

[73] Assignee: Aisin Seiki Kabushiki Kaisha, Aichi-pref., Japan

[21] Appl. No.: 703,878

[22] Filed: Aug. 27, 1996

[30] Foreign Application Priority Data

Aug. 29, 1995 [JP] Japan ..... 7-220569
Aug. 8, 1996 [JP] Japan ..... 8-210290

[51] Int. Cl.[6] ..... F04B 49/00

[52] U.S. Cl. ..... 417/286; 417/310; 417/428

[58] Field of Search ..... 417/286, 428, 417/429, 199.1, 310; 418/3

[56] References Cited

U.S. PATENT DOCUMENTS 3,924,971 12/1975 Jacquot ..... 417/286
4,913,102 4/1990 Ohmura et al. ..... 417/310
5,032,065 7/1991 Yamamuro et al. ..... 417/429
5,094,597 3/1992 Takai et al. ..... 417/428
5,199,854 4/1993 Aoyama ..... 417/428
5,713,726 2/1998 Nakayoshi ..... 417/310

*Primary Examiner*—Timothy Thorpe
*Assistant Examiner*—Cheryl J. Tyler
*Attorney, Agent, or Firm*—Hazel & Thomas

[57] ABSTRACT

A tandem pump apparatus is featured having a main suction passage connected to a fluid source. The main suction passage branches into first and second suction passages which, in turn, feed into first and second pumps. Each pump discharges a portion of the fluid to a return passage that is fluidly connected to the suction port of each respective pump. In each return passage, a return control valve is disposed to control the amount of fluid returned to the suction port. The tandem pump featured in this invention exhibits increased efficiency and decreased noise.

5 Claims, 5 Drawing Sheets

TANDEM PUMP APPARATUS

FIELD OF THE INVENTION

The present invention relates to a tandem pump apparatus.

BACKGROUND OF THE INVENTION

A tandem pump apparatus is disclosed in, for example, Japanese Utility Patent Application laid-open Publication Number 5(1993)-986. This tandem pump apparatus includes a driving shaft, a main pump, a sub pump, a main return passage, a sub return passage, a main return flow control valve, a sub return flow control valve and a suction passage. The main pump and the sub pump are located in parallel and are driven by the driving shaft. Both the main pump and the sub pump have a suction port and a discharge port, respectively. The main pump discharges the fluid sucked from the suction port through the discharge port, and the sub pump discharges the fluid sucked from the suction port through the discharge port. The main return passage returns a part of the fluid discharged from the discharge port of the main pump into the suction port of the main pump. The sub return passage returns a part of the fluid discharged from the discharge port of the sub pump into the suction port of the sub pump. The main return flow control valve controls an amount of the fluid which is returned to the suction port of the main pump through the main return passage. The sub return flow control valve controls an amount of the fluid which is returned to the suction port of the sub pump through the sub return passage. The suction passage joins to the main return passage which is between the main return flow control valve and the suction port of the main pump, and joins to the sub return passage which is between the sub return flow control valve and the suction port of the sub pump.

In the pump apparatus which a part of the fluid discharged from the discharge port is returned to the return passage connected to the suction port and the suction passage, variable conditions such as the length of the return passage which is located between the connection portion of the suction passage and the connecting portion of the suction port, the cross section of the return passage, the speed of flowing fluid in the return passage and the pressure of flowing fluid in the return passage are optimally adjusted. The fluid is effectively sucked from the suction passage into the return passage by a supercharging effect and the fluid pressure in the return passage which is located between the connecting portion of the suction port and the connecting portion of the suction passage is increased so that cavitation is not generated.

In the above mentioned prior tandem pump apparatus, however, since one suction passage is connected to the main return passage and the sub return passage, respectively, it is very difficult to optimally adjust the above-mentioned variable conditions. Therefore, this pump is not able to efficiently obtain the supercharging effect and the fluid including bubbles generated by cavitation is sucked into the suction port. As a result, the efficiency of the pump is decreased and noise is generated.

SUMMARY OF THE INVENTION

Accordingly, it is an object of the present invention to provide a tandem pump apparatus without the foregoing drawbacks.

In accordance with the present invention, a tandem pump apparatus includes a first pump having a suction port and a discharge port for discharging the fluid sucked from the suction port, a second pump having a suction port and a discharge port for discharging the fluid sucked from the suction port, a driving shaft driving the first pump and the second pump, a first return passage connecting the discharge port of the first pump with the suction port of the first pump for returning a part of the fluid discharged from the discharge port into the suction port, a second return passage connecting the discharge port of the second pump with the suction port of the second pump for returning a part of the fluid discharged from the discharge port into the suction port, a first return flow control valve disposed in the first return passage for controlling an amount of the fluid which is returned to the suction port of the first pump through the first return passage, a second return flow control valve disposed in the second return passage for controlling an amount of the fluid which is returned to the suction port of the second pump through the second return passage, a main suction passage connected with a fluid source, a first suction passage connecting the main suction passage with the first return passage which is located between the first return flow control valve and the suction port of the first pump, and a second suction passage connecting the main suction passage with the second return passage which is located between the second return flow control valve and the suction port of the second pump.

Other objects and advantages of invention will become apparent during the following discussion of the accompanying drawings.

BRIEF DESCRIPTION OF THE DRAWINGS

The foregoing and additional features of the present invention will become more apparent from the following detailed description of preferred embodiments thereof when considered with reference to the attached drawings, in which.

DETAILED DESCRIPTION OF THE PREFERRED EMBODIMENTS

Figure 1:
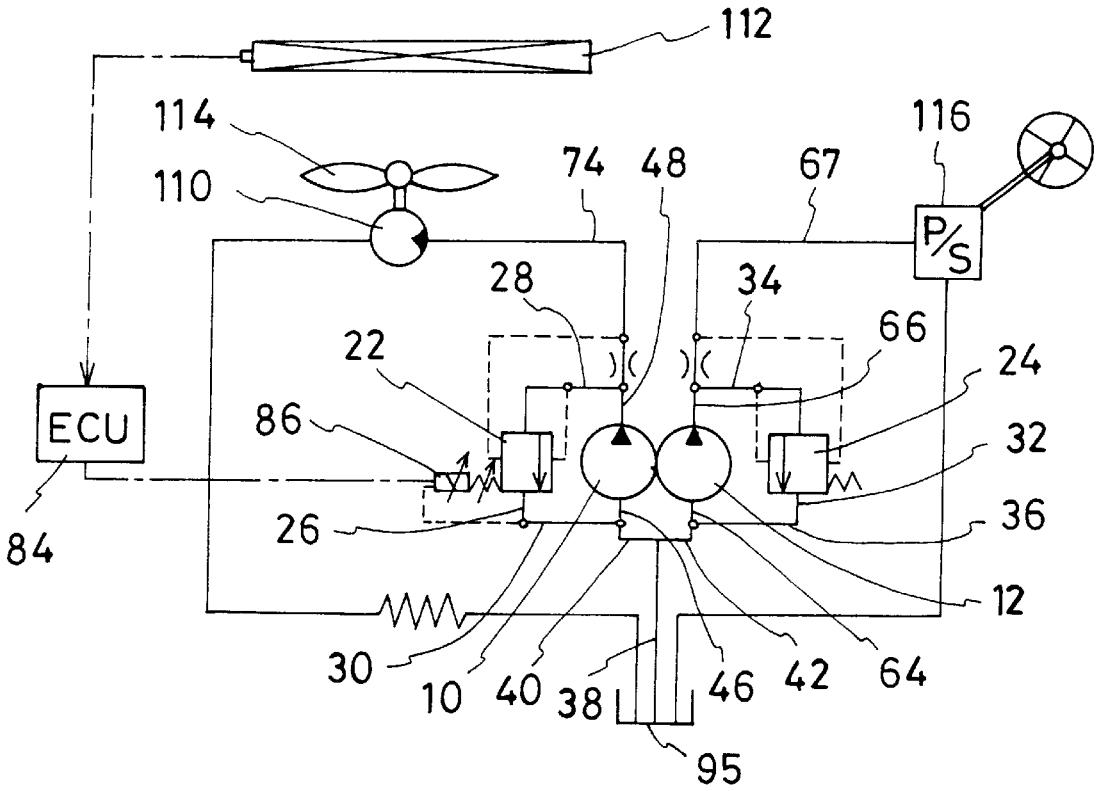
FIG. 1 is a system diagram of an embodiment of a tandem pump apparatus in accordance with the present invention.
Figure 2:
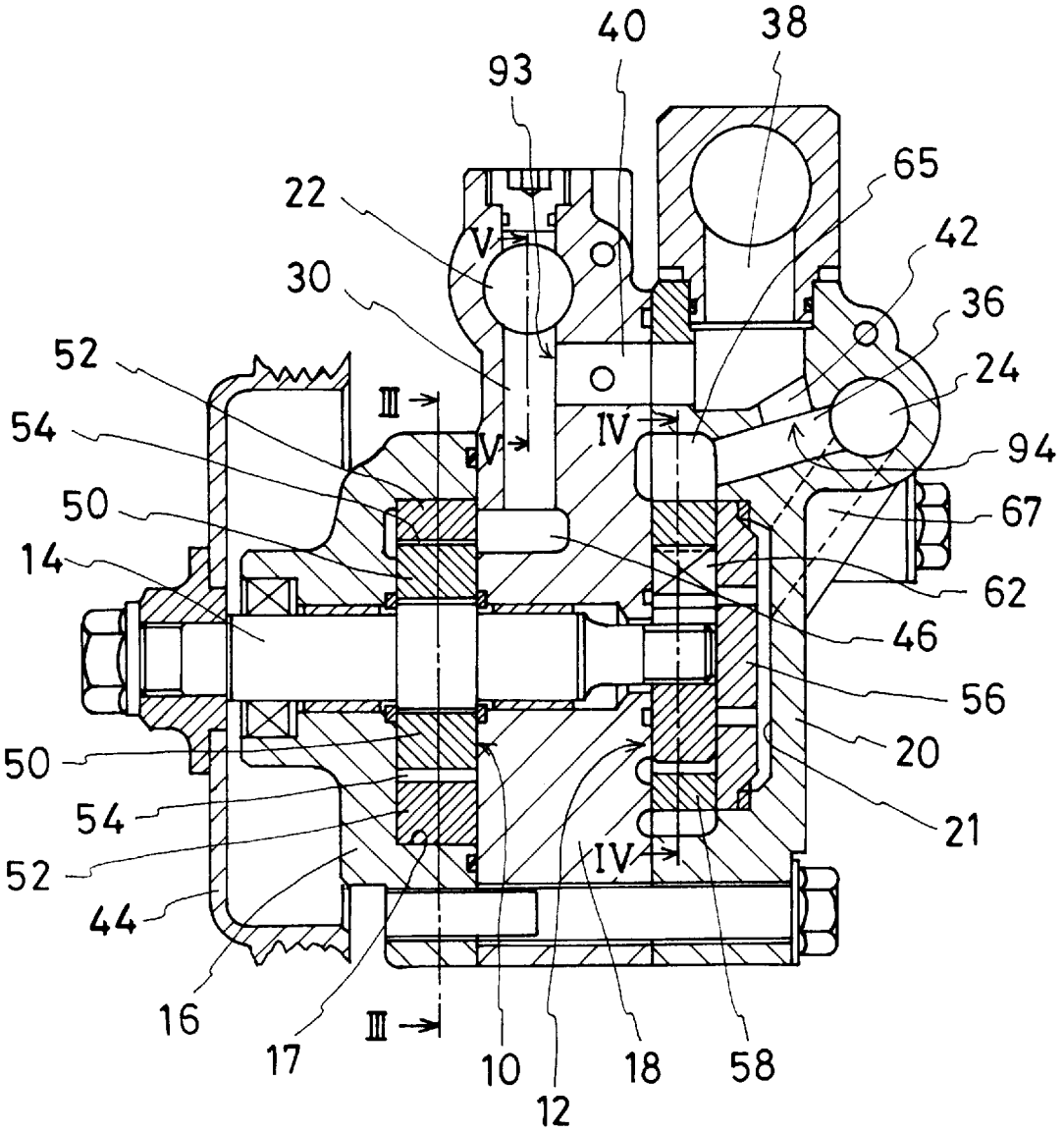
FIG. 2 is a sectional view of an embodiment of a tandem pump apparatus in accordance with the present invention.

Referring to FIG. 1 and FIG. 2, there is shown a preferred embodiment of the tandem pump apparatus of the present invention.

The tandem pump apparatus has a first pump 10, a second pump 12, and a drive shaft 14 for driving the first pump 10 and the second pump 12. As shown in FIG. 2, a housing of the tandem pump apparatus includes a front housing 16, a center body 18 and a rear housing 20. The tandem pump apparatus has the first return flow control valve 22, a second return flow control valve 24, a first return passage 26, a second return passage 32, a main suction passage 38, a first suction passage 40 and a second suction passage 42.

As shown in FIG. 2 the drive shaft 14 penetrates the front housing 16 and the center body 18, and inserts into the rear housing 20. One end of the drive shaft 14 is fixed to a pulley 44 which is driven by an engine through a timing belt (not shown).

Figure 3:
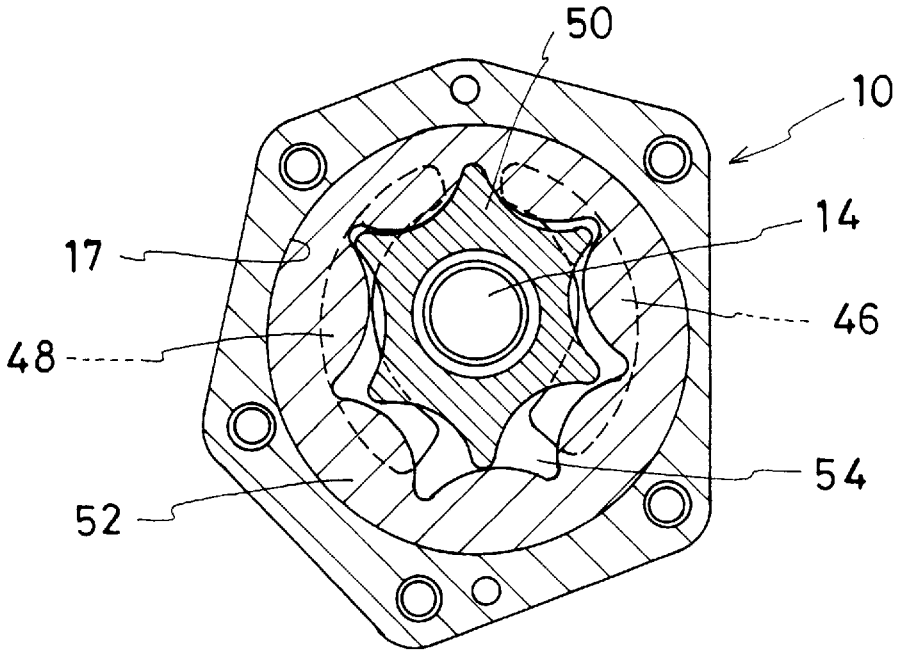
FIG. 3 is a section taken on line A—A in FIG. 2 in accordance with the present invention.

The first pump 10 is a torched type pump which is located between the front housing 16 and the center body 18. As shown in FIG. 2 and FIG. 3, the first pump 10 includes a suction port 46 and a discharge port 48 which are located in the center body 18, an inner rotor 50 which is fixed to the drive shaft 14 and thereby to the pulley 44, and an outer rotor 52 which is rotatably located in a concave portion 17 of the front housing 16. The outer rotor 52 is engaged with the inner rotor 50 forming a plurality of pump chambers 54 between the outer rotor 52 and the inner rotor 50.

The first return passage 26 is formed in the center body 18 so that a part of the fluid discharged from the discharge port 48 is returned to the suction port 46. The first return control valve 22 is disposed in the center body 18, and is higher than the drive shaft 14 as shown in FIG. 2. The first return control valve 22 is disposed in the first return passage 26 and controls the amount of fluid which is returned to the suction port 46 in response to a control signal of ECU 84 based on the temperature of the cooling water in the radiator 112. The first return passage 26 includes a first upstream part 28 which extends from the discharge port 48 to the first return control valve 22, and a first downstream part 30 which extends from the first return control valve 22 to the suction port 46. As shown in FIG. 2, the first downstream part 30 extends from the first return control valve 22 to the suction port 46.

Figure 5:
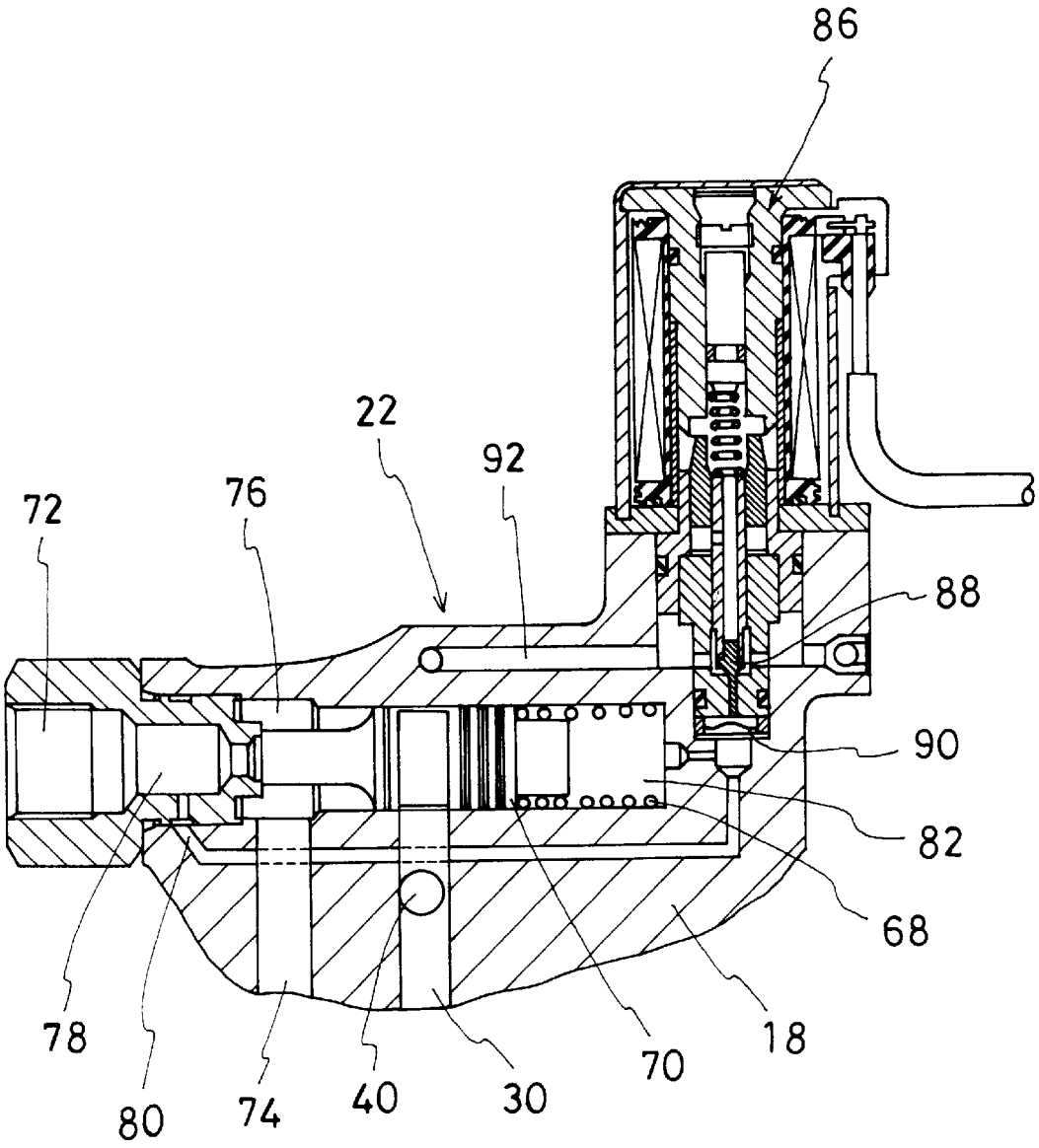
FIG. 5 is a section taken on line C—C in FIG. 2 in accordance with the present invention.

The first return control valve 22 includes a spring 68, a spool valve 70 and a linear electromagnetic valve 86. As shown in FIG. 5, the top 72 of the spool valve 70 is near a housing which forms a chamber 78, but the top has some openings (not shown) so that the first discharge passage 74 always communicates with the chamber 78. The spring 68 presses the spool valve 70 toward the leftward direction as shown in FIG. 5. However, the force of the spring 68 is smaller than the fluid pressure of a chamber 76 of a discharge passage 74 so that the spool valve 70 is pressed toward the rightward direction during operation. A part of the fluid pressure of a chamber 78 of the discharge passage 74 is drawn into a spring chamber 82 through a forked passage 80. Therefore, the resultant force of the spring 68 and the fluid pressure of the spring chamber 82 is able to move the spool valve 70 toward the leftward direction as shown in FIG. 5 against the fluid pressure of chamber 76. The linear electromagnetic valve 86 includes a valve 88, a filter 90 and a fluid passage 92. The linear electromagnetic valve 86 controls the fluid pressure of the spring chamber 82. When the valve 88 is opened, the fluid of the spring chamber 82 is discharged through the filter 90 and the fluid passage 92. When the valve 88 is closed, the fluid of the spring chamber 82 is drawn into the spring chamber 82 through the forked passage 80.

Figure 4:
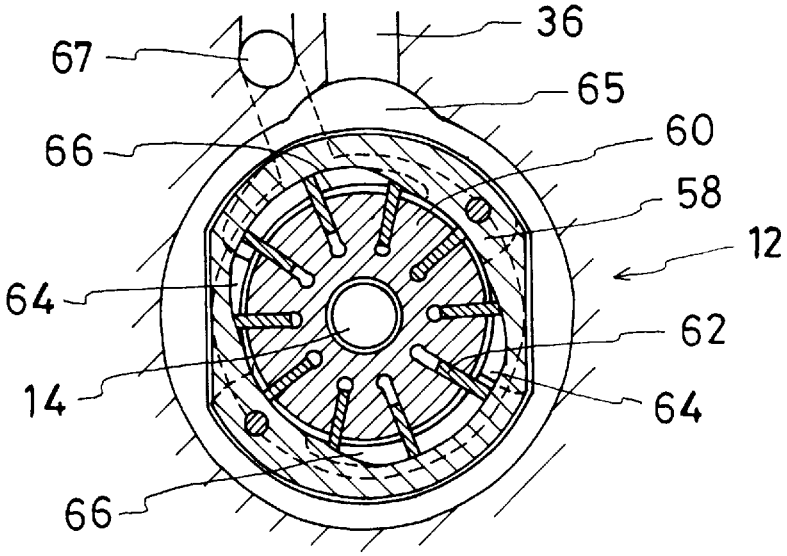
FIG. 4 is a section taken on line B—B in FIG. 2 in accordance with the present invention.

The second pump 12 is a vane type pump which is located between the center body 18 and the rear housing 20. As shown in FIG. 2 and FIG. 4, the second pump 12 includes a pressure plate 56 and a camp ring 58, which are located in the concave portion 21 of the rear housing 20, a rotor 60 which is fixed to the pulley 44, a plurality of vanes 62 which are inserted into the rotor 60, two suction ports 64 and two discharge ports 66. As shown in FIG. 4, the suction ports 64 and the discharge ports 66 are located around the rotor 60. The suction ports 64 are in communication with a suction fluid chamber 65 which is located around the cam ring 58.

The second return passage 32 is formed in the rear housing 20 so that a part of the fluid discharged from the discharge port 66 is returned to the suction port 64. The second return control valve 24 is disposed in the rear housing 20, and is higher than the drive shaft 14 as shown in FIG. 2. The second return control valve 24 is disposed in the second return passage 32 and controls the amount of fluid which is returned to the suction port 64. The construction of the second return control valve 24 is the same as the construction of the first return control valve 22. The second return passage 32 includes the second upstream part 34 which is from the discharge port 66 to the second return control valve 24, and the second downstream part 36 which is from the second return control valve 24 to the suction port 64. As shown in FIG. 2, the second downstream part 36 extends directly from the second return control valve 24 to the suction port 64.

A main suction passage 38 is communicated with the fluid source 95 as shown in FIG. 1. One end of the main suction passage 38 has first and second suction passages 40. The first suction passage 40 is communicated with the first downstream part 30 at a junction 93. The second suction passage 40 is communicated with the second downstream part 36 at a junction 94. The main suction passage 38, the first suction passage 40 and the second suction passage 40 are located higher than the drive shaft 14 as shown in FIG. 2.

At the junction 93, the flow of fluid through the first suction passage 40 and the flow of fluid through the first downstream part 30 are joined. Thereby, low pressure part is apt to be generated in the first downstream part 30 and some air bubbles are apt to separate from the fluid which includes a gas element. If the first pump 10 sucks both the air bubble and the fluid from the suction port 46, the first pump 10 is noisy, and is not able to discharge the necessary amount of fluid into the first discharge passage 74. This problem of the first pump 10 is the same for the second pump 12.

The inventors of the present invention, tried to test for the supercharging effect which prevents some air bubble from separating from the fluid and for prevention of suction of bubbles and got the following results.

Figure 6:
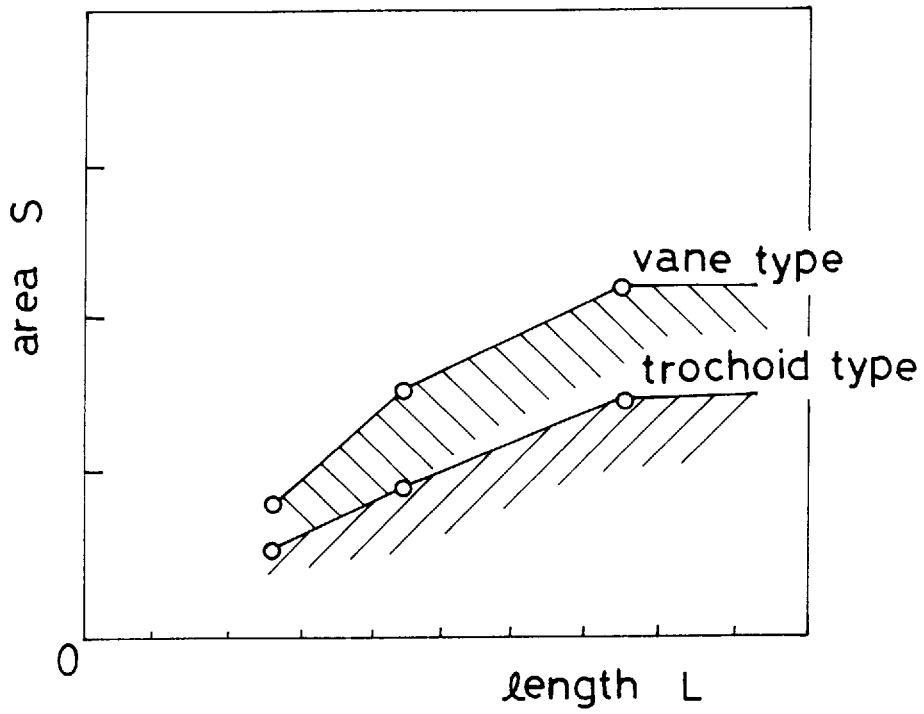
FIG. 6 is a graph which shows the relation between the area of a cross section of a return passage and the length of a return passage.
Figure 7:
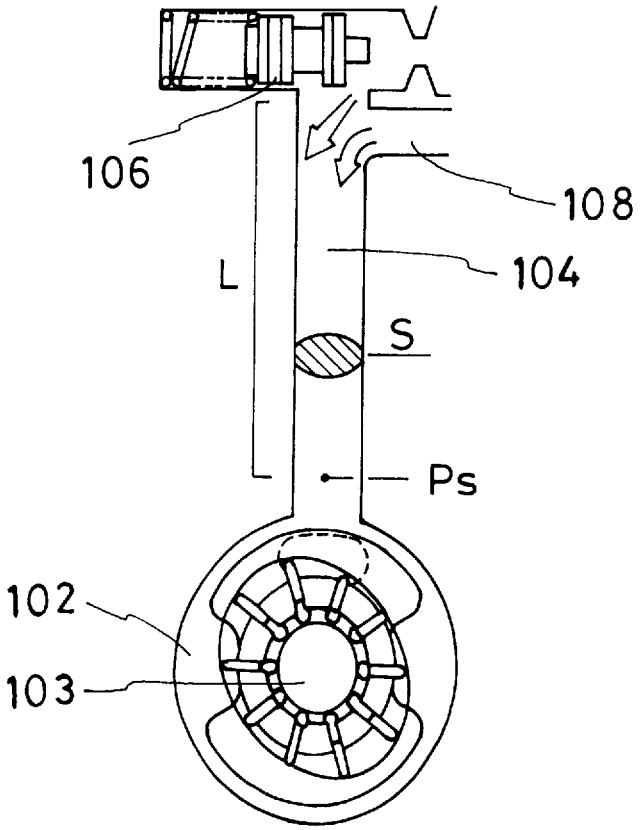
FIG. 7 is a sectional view of a test kit in accordance with a test pump.

FIG. 6 shows the relation between the area S of the cross section of the downstream part 104 and the length L of the downstream part 104 in FIG. 7, as a result of the first test. The first test measured the noise sound level of a test kit as shown in FIG. 7. The test kit includes a test pump 102 which prepare a vane type pump and a trochoid type pump (not shown), a drive shaft 103, the downstream part 104, a return flow control valve 106 and a suction passage 108. For convenience in drawing FIG. 7, the suction passage 108 is drawn so as to be in parallel with the direction of the movement of the return flow control valve 106, but the suction passage 108 is formed so as to be in parallel with the drive shaft 103. The flow pressure in the downstream part 104 and the revolution of the test pump 102 is fixed. The noise sound level is then measured while turning the area S and the length L. The area of the slant lines is a low sound area of the test pumps which are capable of practical use.

The result of the first test shows that the long length L is better than the short length L, when the area S is fixed. If some air bubble occurs from the fluid, the air bubble is not sucked into the test pump 102, because the length L of the downstream part 104 is long and the test pump 102 is located under the junction between the downstream part 104 and the suction passage 108.

Figure 8:
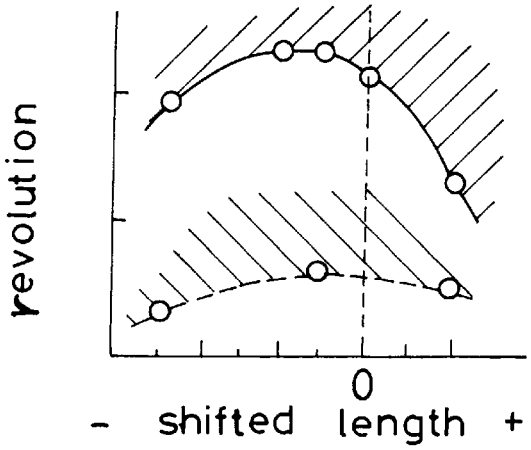
FIG. 8 is a graph which shows the relation between the revolution of a test pump and the shifted length of an axial center of the passages.

FIG. 8 shows the relation between the revolution of a test pump 102 and the shifted length of an axial center of the passages 104 and 108, as a result of the second test. Two types of the area of the cross section of the downstream part 104 are prepared. The opening forward of the return flow control valve 106 is "+" and the closing forward of the return flow control valve 106 is "−". The area of the slant lines is a low sound area of the test pumps which are able to practical use.

The result of the second test shows that the super-charge effect is big, when the center of the suction passage 108 is shifted a prescribed length to the closing forward of the return flow control valve 106 in spite of the area of the cross section of the downstream part 104. Because the flow of the downstream part 104 and the flow of the suction passage 108 are mixed in a spiral so that low pressure part being generated in the downstream part 104 is prevented. Thereby, it is efficiently prevented that bubbles are generated in the fluid by cavitation.

As a result, the following preferred conditions at the junctions 93 and 94 are obtained:

1. The junctions 93 and 94 are adjacent to the first and second return flow control valves 22 and 24 so as to ensure the length of the first and second downstream parts 30 and 36, respectively.
2. The centers of the first suction passages 40 and 42 are shifted a prescribed length with respect to the center of the first and second downstream parts 30 and 36, respectively.

As shown in FIG. 1, the first discharge passage 74 of the first pump 10 is communicated with a flow motor 110 so that a fan 114 is rotated by the flow motor 110 for cooling the radiator. The second discharge passage 67 of the second pump 12 is communicated with a power-steering apparatus 116.

The operation of the above described tandem pump apparatus of the present invention is now explained.

The first pump 10 and the second pump 12 discharge the flow into the first discharge passage 74 and the second discharge passage 67. The amount of flow is in proportion to the rotation of the drive shaft 14. A part of the flow in the first discharge passage 74 returns to the suction port 46 of the first pump 10 through the first return passage 26. The flow in the main suction passage 38 is added to the first downstream part 30 through the first suction passage 40. A part of the flow in the second discharge passage 67 returns to the suction port 66 of the second pump 12 through the second return passage 32. The flow in the main suction passage 38 is added to the second downstream part 36 through the second suction passage 42.

When the temperature of the cooling water in the radiator 112 is cold, electric current is supplied to the linear electromagnetic valve 86 of the first return control valve 22 in response to the control signal from the ECU 84 so that the first upstream part 28 is communicated with the first downstream part 30. The second return control valve 24 makes the amount of flow into the second discharge passage 67 constant.

The first suction passage 40 and the second suction passage 42 are independent. Therefore, air bubbles are eliminated from the fluid which is including the gas element at the junction 93 and 94.

The first return control valve 22, the second return control valve 24, the main suction passage 38, the first suction passage 40 and the second suction passage 42 are disposed at one side of a plane in which an axial center of the drive shaft 14 is included. Therefore, the tandem pump apparatus can be made small. Especially, it is possible to make the first suction passage 40 and the second suction passage 42 so that the occurrence of some air bubbles is reduced.

The first downstream part 30, the second downstream part 36, the first suction passage 40 and the second suction passage 42 are straight.

Therefore, the center body 18 and the rear housing 20 are capable of manufacture.

Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A tandem pump apparatus comprising:

a first pump having a suction port and a discharge port for discharging the fluid sucked from the suction port;

a second pump having a suction port and a discharge port for discharging the fluid sucked from the suction port;

a driving shaft driving the first pump and the second pump;

a first return passage connecting the discharge port of the first pump with the suction port of the first pump for returning a part of the fluid discharged from the discharge port into the suction port;

a second return passage connecting the discharge port of the second pump with the suction port of the second pump for returning a part of the fluid discharged from the discharge port into the suction port;

a first return flow control valve disposed in the first return passage for controlling an amount of the fluid which is returned to the suction port of the first pump through the first return passage;

a second return flow control valve disposed in the second return passage for controlling an amount of the fluid which is returned to the suction port of the second pump through the second return passage;

a main suction passage connected with a fluid source;

a first suction passage connecting the main suction passage with the first return passage which is located between the first return flow control valve and the suction port of the first pump; and a second suction passage connecting the main suction passage with the second return passage which is located between the second return flow control valve and the suction port of the second pump.

2. A tandem pump apparatus as set forth in claim 1, wherein the first return passage, the second return passage, the first return flow control valve, the second return flow control valve, the main suction passage, the first suction passage and the second suction passage are disposed at one side of a plane in which an axial center of the drive shaft is included.

3. A tandem pump apparatus as set forth in claim 2, wherein one end of the first suction passage which is connected with the first return passage is adjacent to the first return flow control valve, and one end of the second suction passage which is connected with the second return passage is adjacent to the second return flow control valve.

4. A tandem pump apparatus as set forth in claim 3, wherein the axial center of one end of the first suction passage is shifted a predetermined distance from the axial center of the first return passage, and the axial center of the end of the second forked suction passage is shifted for a predetermined distance from the axial center of the second return passage.

5. A tandem pump apparatus as set forth in claim 4, wherein the first suction passage is extended perpendicularly with respect to the second return passage, and the second suction passage is extended perpendicularly with respect to the second return passage.

* * * * *